United States Patent [19]

Stackaruk

[11] 4,194,479

[45] Mar. 25, 1980

[54] STACKARUK ENGINE

[76] Inventor: Arthur Stackaruk, 194 Church St., Bowmanville, Ontario, Canada

[21] Appl. No.: 778,626

[22] Filed: Mar. 17, 1977

[51] Int. Cl.[2] ..... F02P 1/00

[52] U.S. Cl. ..... 123/148 C; 123/198 F; 123/148 DS

[58] Field of Search ..... 123/148 DS, 148 E, 198 F, 123/148 C, 146.5 A

[56] References Cited

U.S. PATENT DOCUMENTS

| | | | |
|---|---|---|---|
| 3,647,995 | 3/1972 | Wisely | 123/146.5 A |
| 3,766,339 | 10/1973 | Melivosian | 123/146.5 A |

*Primary Examiner*—Ronald B. Cox

*Attorney, Agent, or Firm*—Leon Arthurs; Kenneth M. Garrett

[57] ABSTRACT

In a four stroke internal combustion engine enhanced combustion within the cylinder is obtained by providing a second ignition spark retarded from the first spark by a flywheel angle of about 30° to about 180°.

13 Claims, 3 Drawing Figures

FIG.1
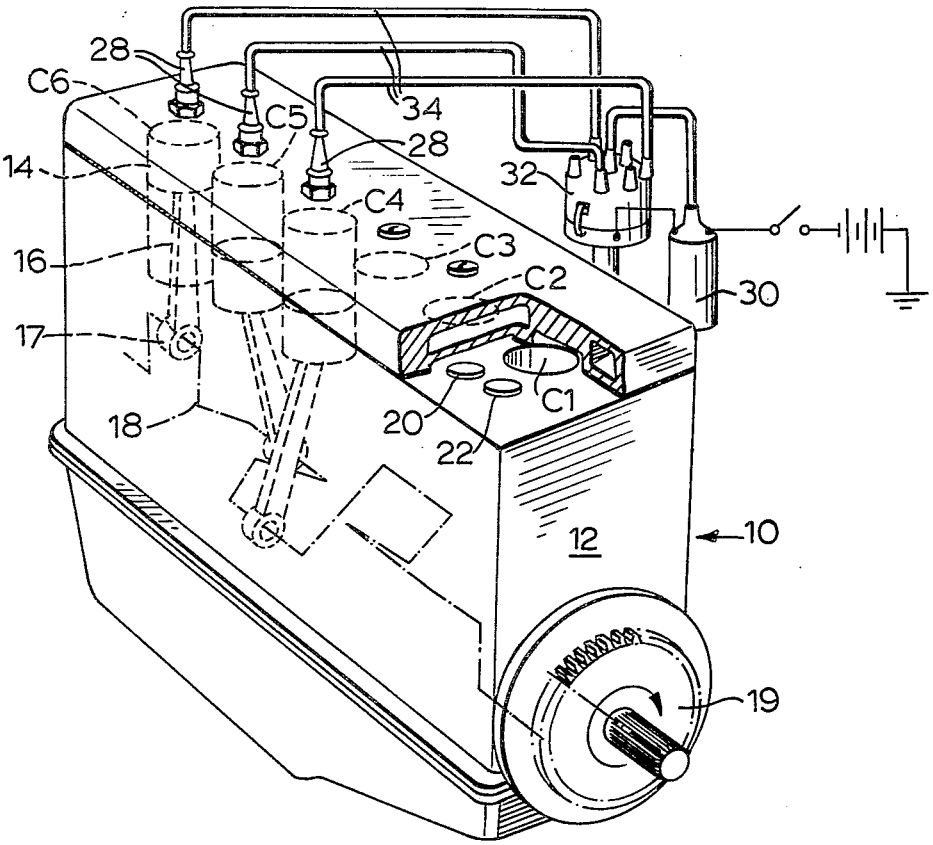
FIG.2
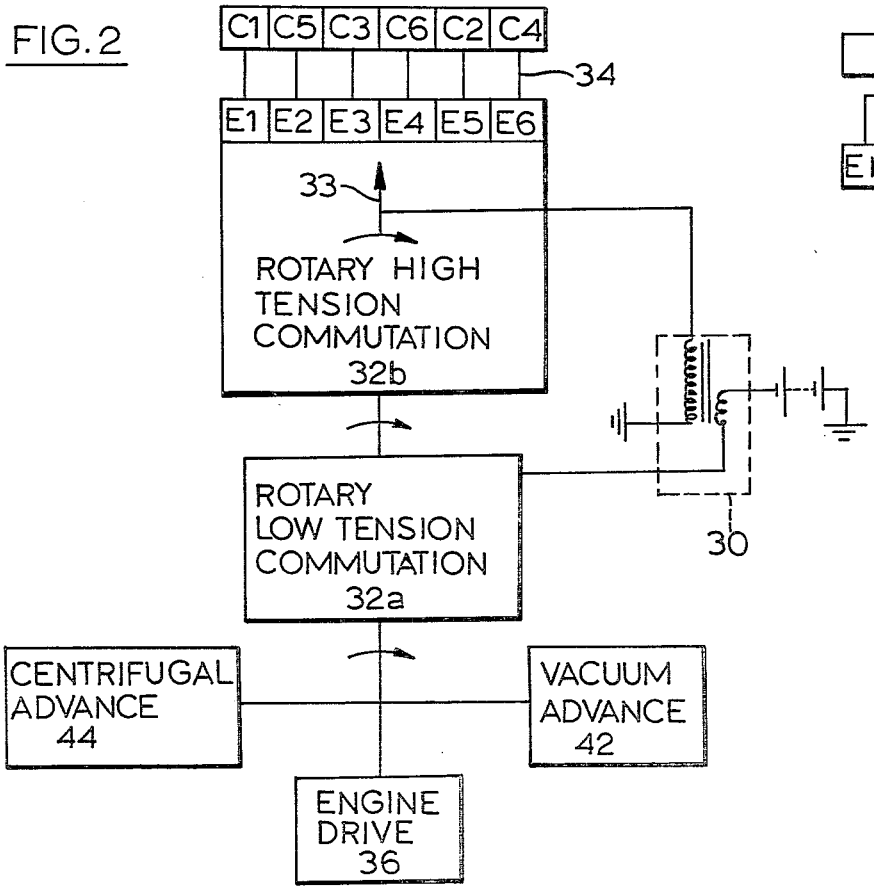
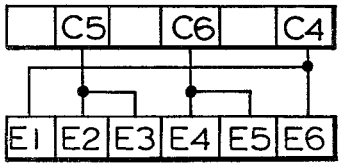
FIG.3

STACKARUK ENGINE

This invention relates to internal combustion engines and improvements there to. It particularly relates to improvements in ignition means for said engines.

The internal combustion engine of the reciprocating piston four stroke type, particularly as used for automotive purposes normally includes ignition means comprising a high voltage generation means such as an induction coil, and means such as a spark plug within the cylinder, the coil and plug being intermittently interconnected through distributor means so as to provide an ignition spark. Generally the spark is timed so as to ignite compressed combustive gases in the cylinder at about maximum compression i.e. at piston top dead centre, which timing may be advanced up to about 30°. The resulting combustion is not usually complete, and the gases exhausted from a properly tuned engine are often required to be catalytically oxidized in order to meet current E.P.A. standards.

I have found that by providing a second ignition spark which is significantly delayed from the first ignition spark by an angle of from about 30° to about 180°, the degree of combustion within the cylinder may be increased so as to substantially oxidize all combustive materials.

I have further found that by the above expedient of providing a dual ignition spark the power output from each cylinder may be increased. This has permitted me to make certain modifications to multicylinder engines whereby the overall fuel consumption of the engine may be considerally decreased without commensurate sacrifice in engine performance. In such modifications up to one half of the cylinders of an engine may be made inoperable, by which I mean placed in a condition where they provide no useful work. This may be for example by merely inactivating the inlet and outlet valves, so that in such cylinders the trapped air functions as an air spring; preferably however, the complete piston, connecting rod and valve actuating assembly of each cylinder to be rendered inoperable is entirely removed from the engine so as to reduce friction and wear.

In a four stroke multicylindered engine there is a predetermined sequence for firing each of the cylinders in succession. Thus the flywheel of such engine will normally rotate twice, i.e. turn 720° during which period each cylinder will fire in the predetermined sequence. Considering an n cylinder engine, where n will normally be an even number in the range 4–16 inclusive, the firing pulses will occur at intervals of 720/n°, i.e. at 180° to 45°. In a preferred embodiment of my invention, alternate cylinders in the normal firing sequence are rendered inoperable and the firing pulse that would normally be provided to each respective inoperable cylinder is redirected to provide the second ignition spark to the respective preceding operable cylinder without requiring any special equipment.

My invention will now be described with reference to the preferred embodiment thereof as illustrated in the accompanying drawings. Such description in not to be taken as limiting the scope of the invention, the full scope of which is defined in the accompanying claims. In the drawings, FIG. 1 shows in schematic form a six cylinder engine;

FIG. 2 shows in block form an unmodified spark generating means for the above engine;

FIG. 3 shows a portion of the above spark generating means reconnected to provide a double ignition spark as required by my invention.

Referring to the figures in detail, an internal combustion engine of normal characteristics is identified generally by the numeral 10. Since engine 10 will be known to those skilled in the art, the following description will be abbreviated to points of particular concern to my invention. Engine 10 comprises an engine block 12 having six cylinders C1–C6 therein. Each cylinder is provided with a piston 14 mounted for for reciprocal movement therein, each piston 14 being linked by a connecting rod 16 to a journal 17 of a crankshaft 18, shown in dotted outline. A flywheel 19 is directly coupled to crankshaft 18. Engine 10 includes valving means comprising inlet valve 20 and exhaust valve 22 for each cylinder, and cam means for actuating each valve optionally through intermediate means which may include rockers and pushrods, none of which is illustrated.

Means for generating an ignition spark for engine 10 includes an induction coil 30 and a spark distributor means 32. Referring to FIG. 2, distributor means 32 will be seen to comprise a rotary low tension commutation portion **32*a*, and a rotary high tension commutation portion 32*b*; The two portions are ganged together and drivingly interconnected through means 36 with crankshaft 18 to rotate at an angular velocity half that of flywheel 19. Typically, the low tension commutation 32*a* comprises a six sided rotary cam which activates a momentary switch (points) interposed in the low tension side of induction coil 30. Also typically, the high tension commutation 32*b* comprises a rotary wiper arm 33 connected to the high tension output of coil 30, and six equi-spaced electrodes designated E1–E6 concentric with the wiper arm and sequentially coupled therewith as the arm rotates. Each electrode is interconnected through a wire conductor 34 to a predetermined spark plug 28 of one of the six cylinders C1–C6**.

Engine 10 is arranged to have predetermined sequence of firing the six cylinders, and will be controlled by the throw of crank shaft 18 and the valve actuating means. In theory up to about 60 different firing sequences are possible for a six cylinder engine, but in practise it is believed that only about 5 different sequences are preferred, as in the table below:

| | | |
|---|---|---|
| 1-5-3-6-2-4 | 1-6-2-4-3-5 | 1-6-5-4-3-2 |
| 1-4-2-5-3-6 | 1-6-3-5-2-4 | |

PREFERRED FIRING SEQUENCES, 6 CYLINDER ENGINE.

Electrodes E1–E6 are then interconnected to the respective spark plugs 28 of cylinders C1–C6 in accordance with the predetermined firing sequence. It is to be assumed that electrode E1 always connects to cylinder C1. Connections for the first of the above firing ssequences are shown in FIG. 2.

The above description is of wholly conventional, internal combustion engine such as is presently employed for automotive purposes, for example. It is included solely for reciting a base structure which may be modified according to my invention.

In providing my invention in a preferred aspect, I first modify engine 10 by rendering half of the cylinders inoperable. Such cylinders will be non-adjacent in the firing sequence of the unmodified engine. Assuming the engine to have the first of the above listed firing sequences, 1—5—3—6—2—4, cylinders 5, 6, 4 may be rendered inoperable leaving cylinders 1, 3, 2 operable, or viceversa. In order to render a cylinder inoperable it is preferred to withdraw the piston 14 and connecting rod 16 of that cylinder and to inactivate the valving mechanism associated therewith. This may be simply by removing push rods in the case where these are mechanically actuated, or by sealing off hydraulic valve lifters in the event that these are employed. Other means may also be employed as will be apparent to these skilled in the art. Alternatively, although less preferred, the selected cylinders may be rendered inoperable by simply inactivating the valving mechanism as described above, whilst leaving the pistons 14 and their interconnecting rods 16 in place. In this event the pistons reciprocate in essentially sealed chambers and function as air springs, with little loss to the ultimate efficiency of engine 10 when further modified as below.

Since the rotary elements of distributor 32 rotate at half engine speed, six high voltage ignition pulses are produced for every two revolutions of flywheel 19. The angular separation between adjacent pulses, in terms of flywheel displacement, is then 720/6, or 120°. This pulse separation is within the range of about 30° to about 180° within which the first and second ignition pulses for each operable cylinder of my modified engine should occur. The reconnection of the high tension commutation means **32*b* to provide this second, delayed spark for each operable cylinder is illustrated in FIG. 3. It is assumed that the normal firing sequence of the unmodified engine is 1—5—3—6—2—4, and that cylinders 4, 5 and 6 are operable, with cylinders 1, 2 and 3 having been rendered inoperable. Thus, in this particular instance, I connect together electrodes to form three pairs E2, E3; E4, E5; and E6, E1, the pairs connecting respectively to the spark plug 28 of cylinders C5, C6 and C4. More generally, it is merely required to interconnect adjacent pairs of electrodes E1–E6**, the first electrode of each pair being the electrode normally associated with the particular operable cylinder being ignited, the second electrode of each pair being that associated with the inoperable cylinder immediately succeeding the operable cylinder in the designed firing sequence. The actual means whereby the electrode pairs are interconnected is by no means critical, and is not therefor illustrated.

As mentioned earlier, the ignition pulse for present day 4 cycle reciprocating engines is usually arranged to occur slightly before the piston reaches top dead centre, up to about 8° as measured on the flywheel being usual. As the engine speed increases means are normally provided to still further advance the ignition pulse. Such means may be manually operated, although most modern engines are equipped with both vacuum advance and centrifugal advance means, respectively denoted in the schematic of FIG. 2 by the numerals 42, 44. Normal practise will advance the ignition pulse by about a further 14° under the influence of vacuum advance 42, and about a further 14° under the influence of centrifugal advance 44. A maximum advance of about 35°–38° before top dead centre is normally provided at engine speeds of about 2,000–2500 rpm. I find that further improvement can be made wherein the first spark is advanced to a maximum of 45° before top dead centre. Preferably the static advance of about 8° is left unchanged, and the additional advance is provided by centrifugal advance 44. This may be by such simple expedient as decreasing the modulus of the counterbalance springs normally employed in such devices, or increasing the arc over which the centrifugal weights may travel. Still further means will be apparent to those skilled in the art.

Whilst I have spoken of engines particularly in the automotive field as normally having a single spark which occurs within about 38° to 8° in advance of top dead centre, it will be known to practitioners in the art that certain current commercial products employ what may be termed a dual spark ignition system. Where such second spark is employed in reciprocating type engines it normally occurs with a delay of only some 5°–10° from the first spark, and it is believed to be employed only for the purpose of enhancing starting. Whilst one advantage of the dual spark ignition system of my invention is found to be in enhanced starting of the engine, the other advantages of my invention in providing a greater degree of combustion under normal running conditions and generally increased power output per operable cylinder are not observed with spark delays of only 5°–10°. Whilst I do not preclude the modification of a present day commercial dual spark ignition engine in accordance with my invention so as to provide in effect 4 ignition pulses for each operable cylinder, the pulses delayed by only 5°–10° from the pair of ignition pulses provided by my invention will be found to be without substantial effect.

From the aforesaid it will be apparent that my invention may be employed with 4 cycle internal combustion engines of the reciprocating piston type generally, and that my conversion method can be applied to multicylindered engines of the type described merely by rendering alternate cylinders in the normal firing sequence inoperable, and connecting the distributor electrode of each inoperable cylinder respectively to the electrode associated with an operable cylinder immediately preceding it in the firing cycle. It will further be apparent that whilst my invention has been described relative to electromagnetic ignition spark generation means any other suitable means, for example piezo electric means, could be employed. The scope of my invention is not to be limited by the specific embodiments thereof described, but according to the embodiments described in the appended claims.

I claim:

1. In the combination of a four stroke internal combustion engine comprising n cylinders, where n is an even number in the range of 4 to 8, each said cylinder normally having a piston mounted for reciprocal movement therein and ignition spark generating means including a single spark plug in each said cylinder for generating a first ignition spark as each respective said piston is in the vicinity of top dead center on the compression stroke, a crankshaft having n cranked journals establishing a normal firing sequence for said engine, the improvement wherein half of said cylinders are rendered inoperable, said inoperable cylinders being non-adjacent in said firing sequence, and wherein the ignition spark normally supplied to a cylinder rendered inoperable is supplied to an adjacent operable cylinder in said normal firing sequence to generate a second ignition spark at the respective single spark plug with an angular retard within the range of about 90° to about 180° from said first spark, as measured at the engine flywheel.

2. The combination of claim 1 wherein said second spark is generated with an angular retard within the range of about 90° to about 120°.

3. The combination of claim 1 wherein said spark generating means comprises a high voltage source means, high voltage distribution means including a wiper arm electrically connected to said high voltage means, first and second adjacent electrodes successively interconnectable with said wiper arm and electrically interconnected to said spark plug so as to provide first and second successive high voltage pulses to each said operable cylinder to generate said first and second ignition sparks.

4. The combination of claim 1 wherein said first spark is generated under normal running conditions at an advance of about 45° before top dead centre.

5. The combination of claim 3 wherein said first spark is generated under normal running conditions at an advance of about 45° before top dead centre, and wherein said second spark is retarded from said first spark by an angle in the range of about 90° to 120°.

6. An improved method of operating a four stroke internal combustion engine comprising n cylinders, where n is an even number in the range of 4 to 8, each said cylinder normally having a piston mounted for reciprocal movement therein and a single spark plug, ignition means for generating a single spark at each said spark plug in the vicinity of top dead center, comprising inactivating half of said cylinders, the inactivated cylinders being non-adjacent in the normal firing sequence of said engine, and supplying the spark pulse normally provided at the spark plug of an inactivated cylinder to the spark plug of an adjacent cylinder so as to to thereby generate a second spark in said adjacent cylinder retarded from said first spark by an angle within the range of about 90° to about 180° as measured at the engine flywheel.

7. In the combination of four stroke internal combustion engine including at least one cylinder having a piston mounted for reciprocal movement therein, spark generating means including a single spark plug in each cylinder for generating a first ignition spark as said piston is in the vicinity of top dead center on the compression stroke, the improvement wherein said spark generating means generates a second ignition spark at said single spark plug with an angular retard within the range of about 90° to about 180° from said first spark and wherein said first spark is generated under normal running conditions at an advance of about 45° before top dead center, as measured at the engine flywheel.

8. The combination of claim 1 wherein said spark generating means comprises a high voltage source means, high voltage distribution means including a wiper arm electrically connected to said high voltage source means, first and second adjacent electrodes electrically connected to said spark plug, said first and second adjacent electrodes being contactable by said wiper arm to provide thereby first and second high voltage pulses at said spark plug to generate said first and second ignition sparks, and wherein said second spark is retarded from said first spark by an angle in the range of about 90° to 120°.

9. The method of claim 6 wherein said second spark is retarded by an angle in the range of about 90° to about 120°.

10. The method of claim 6 wherein said second spark is retarded by an angle of about 120°.

11. The method of claim 6 wherein said second spark is retarded by an angle of about 90°.

12. The method of claim 6 wherein said first spark is provided under normal running speeds with an advance of about 45° before top dead centre.

13. The combination of claim 1 wherein each said inoperable cylinder is made inoperable by inactivating at least the inlet valve associated therewith and withdrawing the piston and connecting rod thereof.

* * * * *